US007617840B1

(12) United States Patent
Zinda

(10) Patent No.: US 7,617,840 B1
(45) Date of Patent: Nov. 17, 2009

(54) SELF PACKING NON LEAK HOSE STORAGE SYSTEM

(76) Inventor: Robert A Zinda, W993 Harmony Lane East, East Troy, WI (US) 53120

( * ) Notice: Subject to any disclaimer, the term of this patent is extended or adjusted under 35 U.S.C. 154(b) by 494 days.

(21) Appl. No.: 11/582,535

(22) Filed: Oct. 16, 2006

(51) Int. Cl.
*B65H 75/34* (2006.01)

(52) U.S. Cl. ..... 137/355.23; 242/129.1; 242/388.9

(58) Field of Classification Search ..... 137/355.16, 137/355.17, 355.18, 355.19, 355.2, 355.23, 137/355.25, 355.22, 355.24, 355.28; 242/228, 242/256, 383.5, 383.4, 388.6, 388.9, 396.4, 242/399, 439.4, 155 R, 47.5, 129.1; 222/74; 384/50, 46; 248/329, 328, 331, 330.1, 332, 248/334.1
See application file for complete search history.

(56) References Cited

U.S. PATENT DOCUMENTS

| | | | | | |
|---|---|---|---|---|---|
| 1,468,620 | A | * | 9/1923 | Addy | 137/355.23 |
| 2,660,337 | A | * | 11/1953 | Harks | 222/74 |
| 3,534,766 | A | * | 10/1970 | Barto | 137/351 |
| 4,023,387 | A | | 5/1977 | Gould | |
| 4,057,211 | A | * | 11/1977 | Moore | 248/332 |
| 4,057,220 | A | * | 11/1977 | Kudlacek | 254/376 |
| 4,586,676 | A | | 5/1986 | Johnston et al. | |
| 4,723,568 | A | | 2/1988 | Adams | |
| 5,117,859 | A | | 6/1992 | Carlson | |

FOREIGN PATENT DOCUMENTS

| | | |
|---|---|---|
| DE | 3309319 | 9/1984 |
| GB | 590.766 | 7/1947 |
| GB | 796.205 | 6/1958 |
| GB | 911.635 | 11/1962 |
| GB | 1.166.842 | 10/1969 |
| GB | 2.312.198 | 10/1997 |
| JP | 59143878 | 8/1984 |
| JP | 7284215 | 10/1995 |

* cited by examiner

*Primary Examiner*—John Rivell
*Assistant Examiner*—Macade Brown
(74) *Attorney, Agent, or Firm*—Michael I Kroll

(57) ABSTRACT

The present invention discloses a device for dispensing and retrieving a length of hose. A housing contains upper and lower roller guides, a brake drum, a ratchet mechanism and a block and tackle assembly. As the hose is pulled out of the housing the upper roller guides move towards the lower roller guides and energy is stored in the block and tackle mechanism. The break drum and ratchet mechanism prevent the hose from being wound into the housing until the release mechanism is activated. One the release mechanism is activated the hose is wound into the housing by the energy stored in the block and tackle mechanism causing the upper roller guides to move away from the lower roller guides.

18 Claims, 14 Drawing Sheets

SELF PACKING NON LEAK HOSE STORAGE SYSTEM

BACKGROUND OF THE INVENTION

1. Field of the Invention

The present invention relates generally to hose reels and, more specifically, to a storage device for a hose having a system whereby a user can selectively pull a hose out to a desired length and selectively withdrawn back into the storage device by means of utilizing potential energy stored within a block and tackle mechanism that is charged by the pulling of the hose out of the device. In the fully retracted position the hose is wound around a plurality of upper and lower hose guides having a plurality of rollers set apart at a gapping where said hose is held in an oval like configuration so that when the hose is withdrawn potential energy is stored in a block and tackle device until selective release whereupon the block and tackle mechanism exerts the stored potential energy into retracting the hose back to its original oval like winding.

2. Description of the Prior Art

There are other winding devices designed for spooled material. Typical of these is U.S. Pat. No. 4,023,387 issued to Gould on May 17, 1977.

Another patent was issued to Johnston, et al. on May 6, 1986 as U.S. Pat. No. 4,586,676. Yet another U.S. Pat. No. 4,723,568 was issued to Adams on Feb. 9, 1988 and still yet another was issued on Jun. 2, 1992 to Carlson as U.S. Pat. No. 5,117,859.

Another patent was issued to Pillin on Jul. 28, 1947 as U.K. Patent No. GB590,766. Yet another U.K. Patent No. GB796,205 was issued to ARO Equipment Corporation on Jun. 4, 1958. Another was issued to UK Atomic Energy Authority on Nov. 28, 1962 as U.K. Patent No. GB911,635 and still yet another was issued on Oct. 8, 1969 to Dean Manufacturing Engineers as U.K. Patent No. GB1,166,842. Another patent was issued to Hosoyama on Aug. 17, 1984 as Japanese Patent No. JP59143878. Yet another German Patent No. DE3309319 was issued to Kuestermeyer on Sep. 20, 1984. Another was issued to Richiyaado on Oct. 27, 1995 as Japanese Patent No. JP7284215. Another was issued to Bertagna on Oct. 22, 1997 as U.K. Patent No. GB2,312,198.

U.S. Pat. No. 4,023,387

Inventor: Ronald Jay Gould

Issued: May 17, 1977

A cable employing device for securing frames to poles and posts; a cable dispensing and recovering casing secureable to a frame which includes releaseable engaging means for one cable end; an improved tensioning system for a cable dispensing casing which ordinarily retains the cable in the casing and returns the cable to the casing after use; a cable retention and return device for use in a cable dispensing container which employs a length of surgical tubing to power the cable retention and return; hinged enclosures for simultaneous enclosure of a cable dispensing system and engagement of a frame support.

U.S. Pat. No. 4,586,676

Inventor: Damon A. Johnston, et al.

Issued: May 6, 1986

A garden hose storage apparatus having a base and a storage reel rotatably mounted on the base for windably receiving a garden hose. A shelf is secured to the base. The shelf contains an aperture for movably receiving a garden hose. A plurality of rollers is rotatably mounted in the aperture. Said rollers are engageable with the hose to facilitate movement of the garden hose through the aperture for guiding the garden hose on and off the reel.

U.S. Pat. No. 4,723,568

Inventor: Truman W. Adams

Issued: Feb. 9, 1988

A hose reel mechanism designed for carrying two separate, yet interconnected, lengths of hose includes a tubular metal frame which is provided with support wheels, a supporting base portion and a handle portion. Carried by this frame are two substantially identical hose reels, each of which are supported by an axle, the ends of each axle being secured by the sides of the frame. Each reel is designed to receive a length of hose wherein the hose disposed on the lower reel connects to the faucet and the hose on the upper reel is used for watering at a remote-use location. As the frame is moved away from the faucet, the hose wound on the lower reel is able to unwind automatically and once the frame is positioned at the desired location, the length of hose on the upper reel may be pulled at its free end for unwinding that hose from the top reel. When the watering activity is finished, the length of hose on the upper reel may be rewound onto that reel manually or alternatively by a spring-loaded mechanism, and the length of hose on the lower reel rewinds automatically as the frame is pushed back toward the faucet due to the driving action of the wheels and a belt and pulley arrangement which connects the wheel axle to the axle of rotation of the lower reel.

U.S. Pat. No. 5,117,859

Inventor: James B. Carlson

Issued: Jun. 2, 1992

An above-ground gravity return hose retractor, which is particularly useful in service stations for supplying air and water, encloses the hoses and the retraction mechanism within a cabinet. A block and tackle pulley arrangement, including a vertically movable pulley sheave supported by the hose, is located within the cabinet. The movable pulley sheave has a non-linear, variable weight attached to it in the form of an elongated chain having a first segment of small, relatively lightweight links attached through a limit spring to the sheave. These lightweight links then are attached to an additional segment of chain having intermediate weight links, with the lowermost portion of the chain comprising larger, heavier links. The final link in the chain is attached to the bottom of the cabinet. The full length of the chain is reached just prior to the final extension of the hose. The limit spring then provides a significant increase in resistance to further withdrawal of the hose when the chain is fully extended. Upon release, the variable weight chain exerts the greatest pulling force upon initial retraction of the hose, and the retraction pulling force decreases non-linearly to its lowest value when the hose is nearly fully retracted.

U.K. Patent Number GB590,766

Inventor: John Burgoyne Pillin

Issued: Jul. 28, 1947

A self-coiling reel for a hose pipe, cable or the like has a pneumatically-operated rewinding mechanism which is conditioned for operation by withdrawing the hose from its reel. One embodiment of the invention, FIGS. 1 and 2, for a lubricant supply servicing device has a hose 11 wound on the reel 8, which is supported in the casing 1 on a spindle 6 rotatably mounted in the bearing 3 secured to standard; 2 by dowel pins 4 and retaining clips 5, to which is connected the small sprocket 26 engaging a common chain with the sprocket 28 formed integrally with a cable drum 37 mounted rotatably on the shaft 31. A cable 38 from the drum 37 is connected to a piston rod 39 and a piston 40 working in a cylinder 41 which is supplied at its upper end with compressed air through the gland 42, push button valve 44 and tubes 43 and 46. The inner end of the hose 11 is connected to the screwed socket 19 and receives lubricant through the bores 18 and 12 of the flanges 7 and the spindle 6 respectively from the screwed socket 17. The tube 11 is pulled through a fairlead 20 in the casing 1 thus rotating the drum 38 and hence pulling the piston 40 to the top of its stroke, the air in the cylinder being allowed to bleed away through passages 47. When required lubricant servicing is completed the button 45 is pressed to allow air to enter the cylinder 41 above the piston 40 and so force it downwards thus rotating the drums 38 and 8 hence winding the hose 11. In a modification, FIG. 3, the hose 11 is wound round a series of pulleys 48 and 51 supported by a bracket 50 and frame 53 respectively. The frame 53 is connected to a pulley 58 by a cable 59 and a further cable 38 connected to the piston rod 39 encircles a pulley 37 formed integral with the pulley 58. The hose 11, connected direct to a lubricant supply on the casing 1, has its upper end pulled through the fairlead 20 thus pulling the frame 53 upward and the piston downward. When the button 45 is pressed the piston ascends and pulls the frame 53 vertically downward thus drawing in the hose 11.

U.K. Patent Number GB796,205

Inventor: Aro Equipment Corporation

Issued: Jun. 4, 1958

The outlet end 14 of a hose 10 wound on a rotatable reel R is traversed horizontally by a cable 12 connected to the hose end 14 and extending over a pulley P back to the drum on which it is wound in the opposite direction to the hose 10. The reel R, FIG. 4, is rotatably mounted on an axle 32 serving as a supply conduit, e.g., for lubricating oil or compressed air, and fixed in a frame 24 adapted to be attached by brackets 30 to a ceiling 48. The hose 10 is wound on one section 20 of the reel and the cable 12 on a larger diameter section 60, the difference in diameters being the same as the difference between the diameters of the hose and cable or slightly greater to keep the hose taut. The inner end of the hose is connected to a fluid tight coupling 38 surrounding the axle 32 and the outer end is connected to a member 14, FIG. 1A, having an eye 68 for connection of the cable 12 and a flow port for connection of a pipe 16 leading e.g., to a lubricant gun or pneumatic tool. A second cable 62 may be provided in the hose 10 and anchored in the member 14 and coupling 38 to counteract stretching of the hose during unreeling. The hose is guided on to the reel by a grooved wheel 50, FIG. 6, journalled on a threaded rod 52 which causes the wheel 50 to travel across the drum during reeling and unreeling, a bar 54 holding the hose on the wheel 50. In a modification the wheel 50 is freely journalled on a smooth rod.

U.K. Patent Number GB911,635

Inventor: UK Atomic Energy Authority

Issued: Nov. 28, 1962

The outlet end 14 of a hose 10 wound on a rotatable reel R is traversed horizontally by a cable 12 connected to the hose end 14 and extending over a pulley P back to the drum on which it is wound in the opposite direction to the hose 10. The reel R, FIG. 4, is rotatably mounted on an axle 32 serving as a supply conduit, e.g., for lubricating oil or compressed air, and fixed in a frame 24 adapted to be attached by brackets 30 to a ceiling 48. The hose 10 is wound on one section 20 of the reel and the cable 12 on a larger diameter section 60, the difference in diameters being the same as the difference between the diameters of the hose and cable or slightly greater to keep the hose taut. The inner end of the hose is connected to a fluid tight coupling 38 surrounding the axle 32 and the outer end is connected to a member 14, FIG. 1A, having an eye 68 for connection of the cable 12 and a flow port for connection of a pipe 16 leading e.g., to a lubricant gun or pneumatic tool. A second cable 62 may be provided in the hose 10 and anchored in the member 14 and coupling 38 to counteract stretching of the hose during unreeling. The hose is guided on to the reel by a grooved wheel 50, FIG. 6, journalled on a threaded rod 52 which causes the wheel 50 to travel across the drum during reeling and unreeling, a bar 54 holding the hose on the wheel 50. In a modification the wheel 50 is freely journalled on a smooth rod.

U.K. Patent Number GB 1,166,842

Inventor: A.G. Dean Manufacturing

Issued: Oct. 8, 1969

A reel for hoses, cables and the like comprises a rotatable drum on which the material is wound, power-operated means connected to the drum to rewind any material dispensed from the drum, and means to disconnect the power operated means from the drum to enable, when required, material to be freely dispensed from the drum. The power-operated means includes a pulley mounted coaxially on the drum, and a further pulley 30 connected to a motor 25 via a reduction gearing 28, a belt 31 being provided and passing round both pulleys. The means to disconnect the power-operated means from the drum comprises means to release the tension in the belt 31; this is effected by means of an eccentrically mounted roller 32 which is movable away from the belt via a handle 36. An adjustable stop 37 enables a predetermined tension to be applied to the belt. A bevel gear 38 and pinion 39 are provided for manual operation of the drum in the event of an emergency. The drum is mounted on a hollow shaft rotatably mounted on a stationary hollow spindle. The hollow spindle communicates with a collecting housing from which a duct leads for connection to a hose for the supply of liquid; liquid-tight seals are provided between the spindle and the collecting housing.

Japanese Patent Number JP59143878

Inventor: Hosoyama Yoshitarou

Issued: Aug. 17, 1984

PURPOSE: To improve workability by placing a winding cock connected to a hose, near a spray nozzle mounted on the end of said hose and enabling said hose to be automatically wound around a winding drum by means of the closing action of said cock. CONSTITUTION: When a spray cock 64 is closed at the end of a sprinkling operation of a chemical liquid, etc., while a winding cock 62 is also closed, a liquid in a hose 8 and an introduction tube 19 is prevented from flowing outside through a delivery pipe 63, causing liquid pressure working on the right side of a piston 16 to be great and moving the piston 16 leftward. Then, a three-way valve 22 is shifted through a piston rod 15 and a shifter 20, allowing the liquid to flow through introduction tubes 24, 24' into a winding cylinder 2. Accordingly, a piston rod 5 is raised, a pressing roller r1 is pressed against the pulley 2 side of a belt 3 through a tension lever 4, and a winding drum D is rotated through the pulley 2 driven by a prime mover E, the belt 3, and a pulley 1, winding the hose 8.

German Patent Number DE3309319

Inventor: Kuestermeyer Franz Josef

Issued: Sep. 20, 1984

This device is used to guide a power connecting cable, one end of which is always fitted in a plug socket, through an opening in a housing into the interior of the housing, which cable then emerges again via rollers in the housing which are arranged like pulley blocks and at a different point, which is capable of sliding for the cable, if necessary with the aid of a roller, and is equipped at the other end with a plug contact, or is connected permanently or by means of a plug contact to an electrical apparatus, and, if required, remains tensioned corresponding to the respectively selected number of rollers and the weight which is in each case located on the lower roller or rollers, and is available in the respectively required length.

Japanese Patent Number JP7284215

Inventor: Richiyaado EE Baataguna, et al.

Issued: Oct. 27, 1995

PURPOSE: To provide the highly reliable cord retractor device, whose structure is simple and life is long. CONSTITUTION: In this device, a first cord pulley 82 of the first end part of a frame, second cord pulleys 60 and 62 of the second end part and a cord 90, which is wound around these pulleys so that one end 92 is fixed to the first end part 92, and the other end extends from the other end of the frame, are provided. Furthermore, a sliding block, which slidably attaches the second cord pulleys 60 and 62, so that the pulleys are made to approach the first cord pulley 82 along the frame and separated, a spring, which pushes the second cord pulleys 60 and 62 to the second frame end part, and a latching means, which releasably fix the second cord pulleys 60 and 62 to the position approaching the first cord pulley 82, are provided. The second cord pulleys 60 and 62 are moved to the latching position by the pulling with the end of the cord 90, and the cord is extracted.

U.K. Patent Number GB2312198

Inventor: Richard A. Bertagna, et al.

Issued: Nov. 21, 1994

A cord retractor comprises an elongate frame having first and second frame ends to which laterally spaced tracks 18, 20, 22, 24 are fixed and extend therebetween, a first pulley means 82, 84 mounted to the frame at the first end, a pair of movable supports mounted respectively in the tracks for movement between the frame ends, a second pulley means 60, 62 journalled to and positioned between the movable supports, means for urging the movable supports and the second pulley means towards the second frame end, and an intermediate cord storage section 90 wound over each of the pulley means wherein one end 92 of the cord storage section is fixed to one of the frame ends and the other end 106 of the cord storage section is provided with a free end which extends from the frame. Preferably, a latch means 126 releasably secures the movable supports in a latched position adjacent the first frame end, each of the supports having a low friction slide block 50, 52 slidably mounted in the tracks. The means for urging the movable supports and the second pulley means may comprise first and second spring wheels 66, 68 mounted to the frame at the second frame end, wherein first and second tension springs 70, 72 may pass over the spring wheels such that one end thereof may be secured to one of the slide blocks whilst an opposite end may be secured to the first frame end.

While these reel devices may be suitable for the purposes for which they were designed, they would not be as suitable for the purposes of the present invention, as hereinafter described.

SUMMARY OF THE PRESENT INVENTION

A primary object of the present invention is to provide an apparatus for dispensing and retrieving a length of hose.

Another object of the present invention is to provide a storage device for a hose having a system whereby a user can selectively pull a hose out to a desired length and selectively rewind back into the storage device Yet another object of the present invention is to provide an apparatus for a hose using a spring and block and tackle for storing potential energy.

Still yet another object of the present invention is to provide an apparatus for a hose wherein the block and tackle mechanism is charged by pulling the hose out of the storage device.

Another object of the present invention is to provide an apparatus for a hose whereby in the fully retracted position the hose is wound around a plurality of upper and lower hose guides having a plurality of rollers set apart at a gapping.

Yet another object of the present invention is to provide an apparatus for a hose wherein the hose is held in an oval like configuration so that when the hose is withdrawn potential energy is stored in a block and tackle device until selective release.

Still yet another object of the present invention is to provide an apparatus for a hose wherein the block and tackle mechanism exerts the stored potential energy into retracting the hose back to its original storage device.

Additional objects of the present invention will appear as the description proceeds.

The present invention overcomes the shortcomings of the prior art by providing a storage device for a hose having a system whereby a user can selectively pull a hose out to a desired length and selectively withdrawn back into the storage device by means of utilizing potential energy stored within a block and tackle mechanism that is charged by the pulling of the hose out of the device. In the fully retracted position the hose is wound around a plurality of upper and lower hose guides having a plurality of rollers set apart at a gapping where said hose is held in an oval like configuration so that when the hose is withdrawn potential energy is stored in a block and tackle device until selective release whereupon the block and tackle mechanism exerts the stored potential energy into retracting the hose back to its original oval like winding.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

LIST OF REFERENCE NUMERALS

Figure 1:
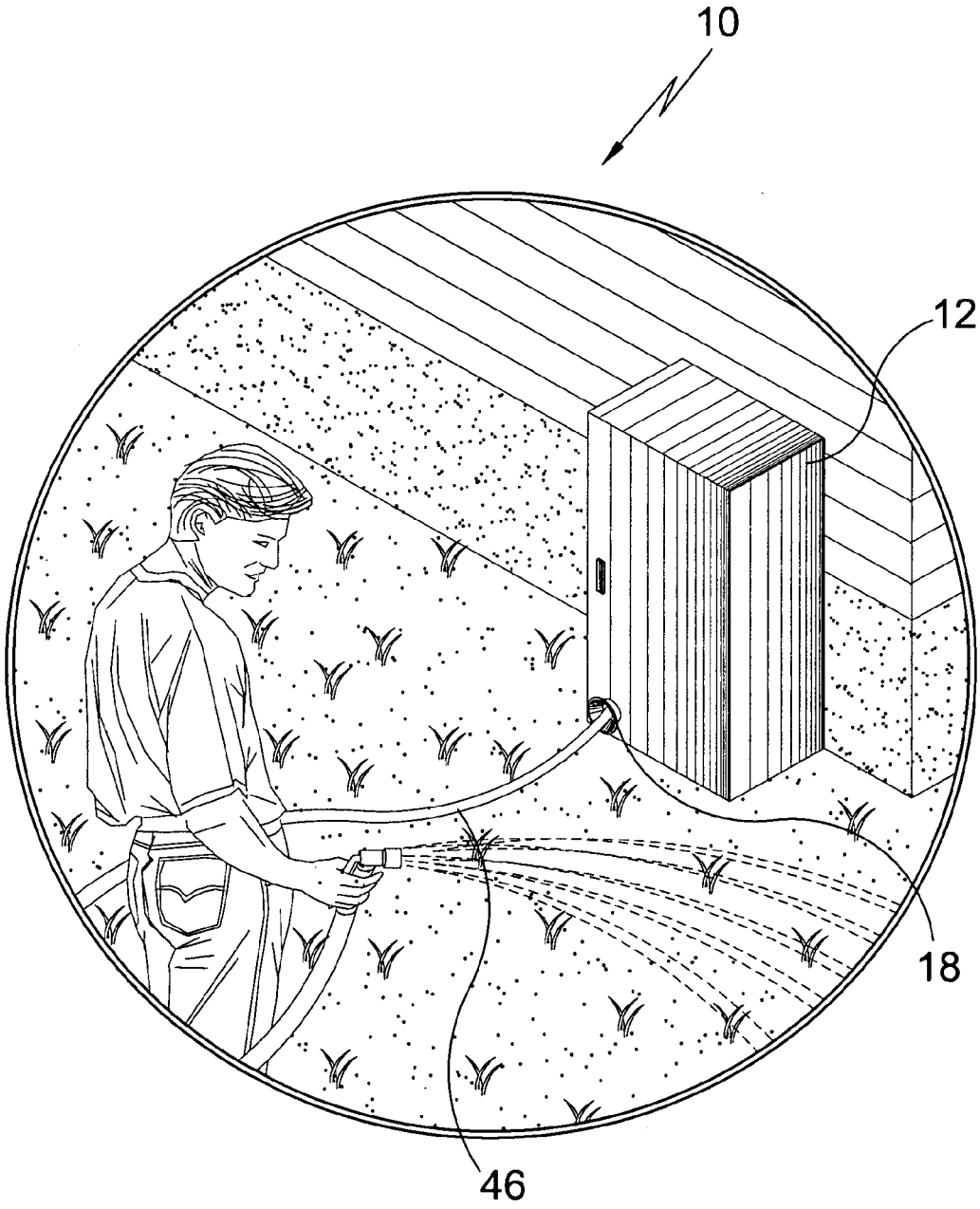
FIG. 1 is an illustrative view of the present invention in use.

With regard to reference numerals used, the following numbering is used throughout the drawings.

10 Present Invention
12 Housing
14 Release Mechanism
16 Linkage
18 Hose Port
20 Upper Roller Guides
22 Lower Roller Guides
24 Brake Drum
26 Ratchet Mechanism
28 Block and Tackle
30 Upper Pulleys
32 Fixed Shaft
34 Lower Pulley
36 Moving Shaft
38 Cable
40 Guide Wheel
42 Guide Track
44 Guide Wheel Shaft
46 Hose
48 Spring
50 Brace
52 Cross Bar
54 Roller
56 Tooth
58 Fixing Plate
60 Through Hole
62 Nipple
64 Lifting Bar
66 Lower Extension
68 End Cap
70 Stop

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. Shown is the present invention 10 being a storage device for a hose 46 having a system for a user to selectively pull a hose 46 out to a desired length and be selectively withdrawn back into said storage device by means of utilizing potential energy stored within a block and tackle mechanism 28 charged by the dispensing of pulling of the hose 46 out of the device.

Figure 2:
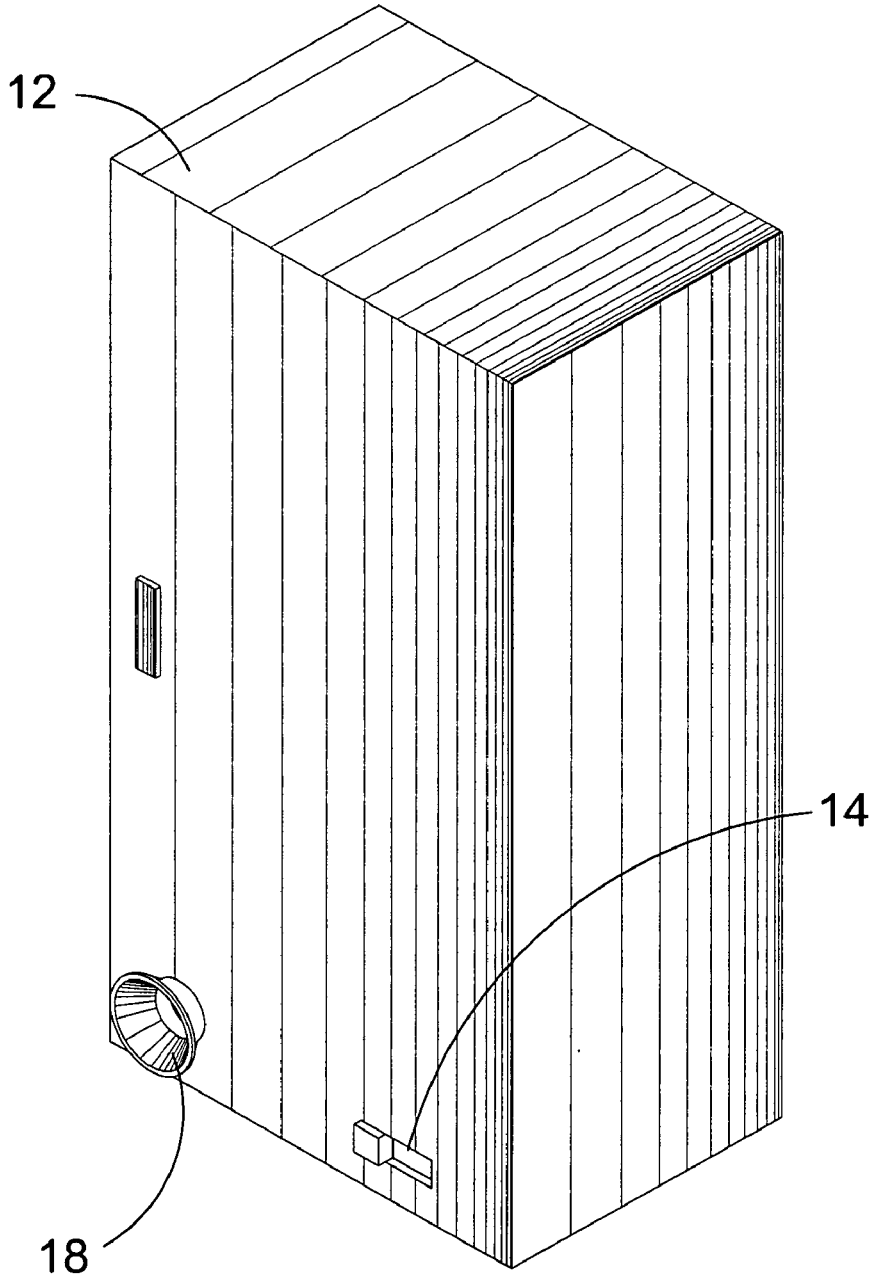
FIG. 2 is a perspective view of the present invention.

FIG. 2 is a perspective view of the present invention 10. Shown is the present invention 10 being a housing 12 for a hose 46 having an internal retracting mechanism powered by the storage of potential energy in a block and tackle mechanism 28.

Figure 3:
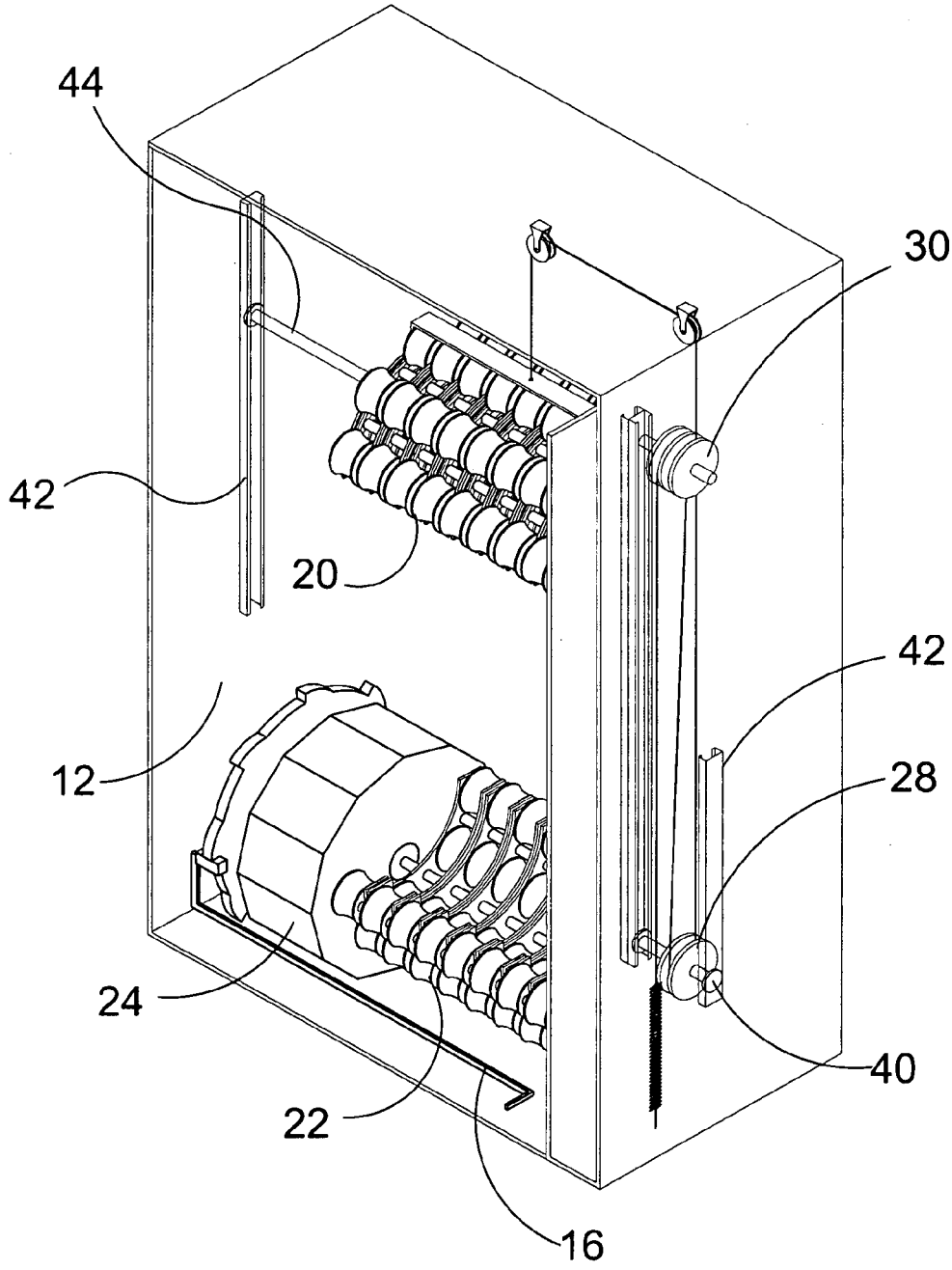
FIG. 3 is a perspective view of the internal components present invention.

FIG. 3 is a perspective view of the internal components of the present invention 10. Shown is the inside of the housing 12 of the present invention 10 depicting the internal components of the present invention 10 showing a set of upper roller guides 20 situated to be raised and lowered during the retraction and extension of hose 46 from the device by usage of a block and tackle mechanism 28. The upper roller guides 20 are attached to a guide wheel shaft 44. The guide wheel shaft 44 has ends that extend beyond left and right ends of the upper roller guides 20. At each end of the guide wheel shaft 44 are guide wheels 40, which are disposed in guide tracks 42 for guiding the vertical movement of the upper roller guides 20. The housing 12 protects and supports the internal components. In addition to the upper roller guides there are lower roller guides 22. The lower roller guides 22 are attached to the brake drum 24. The brake drum 24 and its attached ratchet mechanism 26 prevent the hose 46 from being drawn back into the housing 12 until the user engages the release mechanism 14. The release mechanism 14 causes the linkage 16 to move so that the linkage 16 no longer engages the ratchet mechanism 26 allowing the brake drum 24 to rotate so that the hose 46 is drawn back into the housing by the energy stored in the block and tackle mechanism 28. The release mechanism 14 as seen in the FIG. 2 is a sliding switch. The switch would be biased into an engagement position by a spring or the like. This would ensure that the switch returns to and remains in an engagement position until the user desires to have the hose 46 drawn into the housing 12. It is also contemplated that the release mechanism 14 could be a button that is depressed. This would also be biased into an engagement position.

Figure 4:
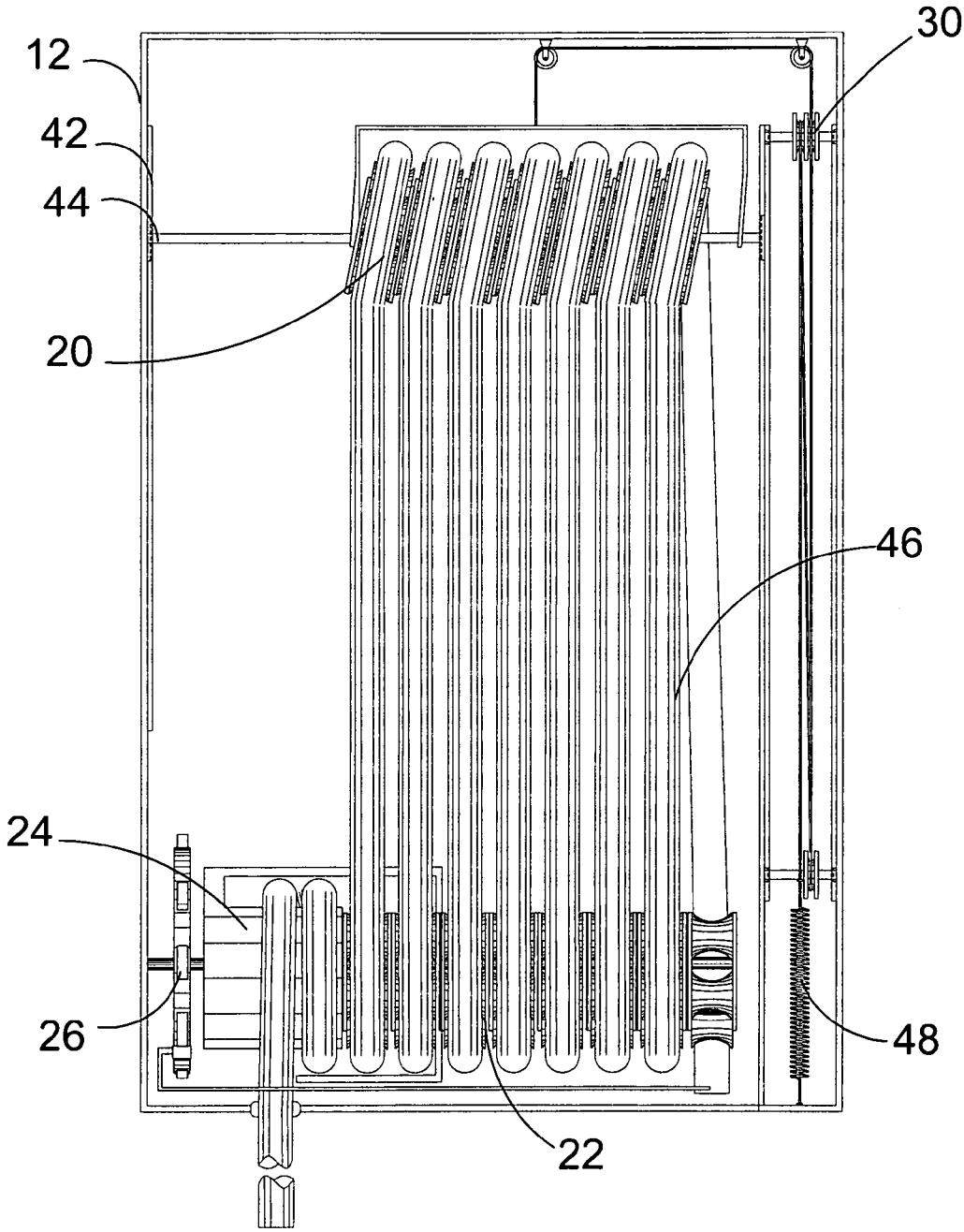
FIG. 4 is a front view of the internal components present invention in the wound position.
Figure 4A:
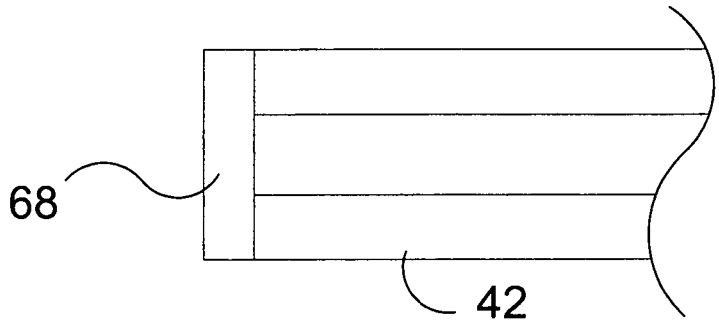
FIG. 4A is a perspective view of an end cap on a guide track of the present invention.
Figure 4B:
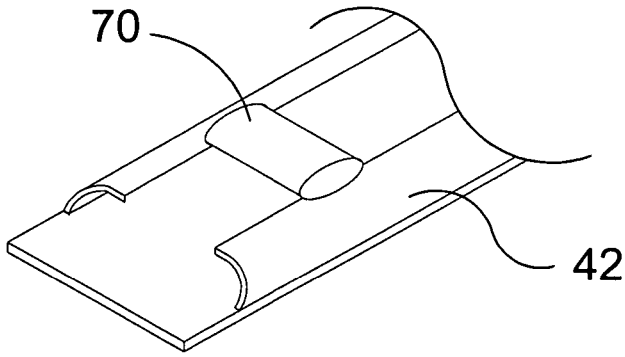
FIG. 4B is a perspective view of a stop on a guide track of the present invention.

FIG. 4 is a front view of the internal components of the present invention 10 in the wound position. Shown is a hose 46 held within the present invention in the wound or fully retracted position whereby the hose 46 is wound around a plurality of upper roller guides 20 and lower roller guides 22 each having a plurality of rollers 54 set apart at a gapping where said hose 46 is held in an oval like configuration whereby said oval configuration is pulled into being circular while the hose is withdrawn, said transition is utilized to store a potential energy gain gathered in a block and tackle mechanism 28 until selective release. The block and tackle mechanism 28 uses three pulleys, an attached spring, and a cable to provide energy storage. The two upper pulleys 30 are attached to a fixed shaft 32. They are free to rotate about the shaft 32 but the shaft 32 is fixed in position so that it cannot move vertically or horizontally. The lower pulley 34 is attached to a moving shaft 36. The moving shaft 36 has guide wheels 40 at each end where the guide wheels 40 are each set in a guide track 42. This arrangement is similar to that of guide wheel shaft 44 which supports the upper or top roller guides. This allows the lower pulley 34 to rotate about the moving shaft 36 and the moving shaft 36 is provided with vertical movement. It is contemplated that the ends of the guide tracks 42 may be closed to prevent the guide wheels 40 from leaving the guide tracks 42 (see FIG. 4A). The ends of the tracks could be closed by a metal end cap 68. It is also contemplated that a stop 70 can be installed in the guide track 42 near or at the end (see FIG. 4B). These will prevent the guide wheels 40 from leaving the guide tracks 42. The stop can be a strip of metal that is secured across the slot in track. A cable 38 connects the upper roller guides 20, the spring 48, and the lifting bar 64 as seen in this figure. One end of the cable 38 is attached to the spring 48 and from there the cable 38 extends vertically to the top left pulley on the fixed shaft 32. The cable 38 wraps around the pulley and then extends downward toward the lower pulley 34 on the moving shaft 36. The cable 38 wraps around the lower pulley 34 and then extends upward and through the right pulley on the fixed shaft 32. The cable 38 then extends over two additional pulleys guiding it to the lifting bar 64. This end of the cable 38 is fixed or attached to the lifting bar 64. The lifting bar 64 supports the guide wheel shaft 44, which holds the upper roller guides 20. The guide wheel shaft 44 can be joined to the lifting bar 64 in many ways. The ends of the lifting bar 64 can be welded to the guide wheel shaft 44. It is also contemplated that the guide wheel shaft 44 will be disposed in through holes near the ends of the lifting bar 64. The top or upper roller guides 20 are angled with respect to the fixed or lower roller guides 22 to improve the continuity of the hose 46 spooling from the upper roller guides 20 to the lower roller guides 22.

Figure 5:
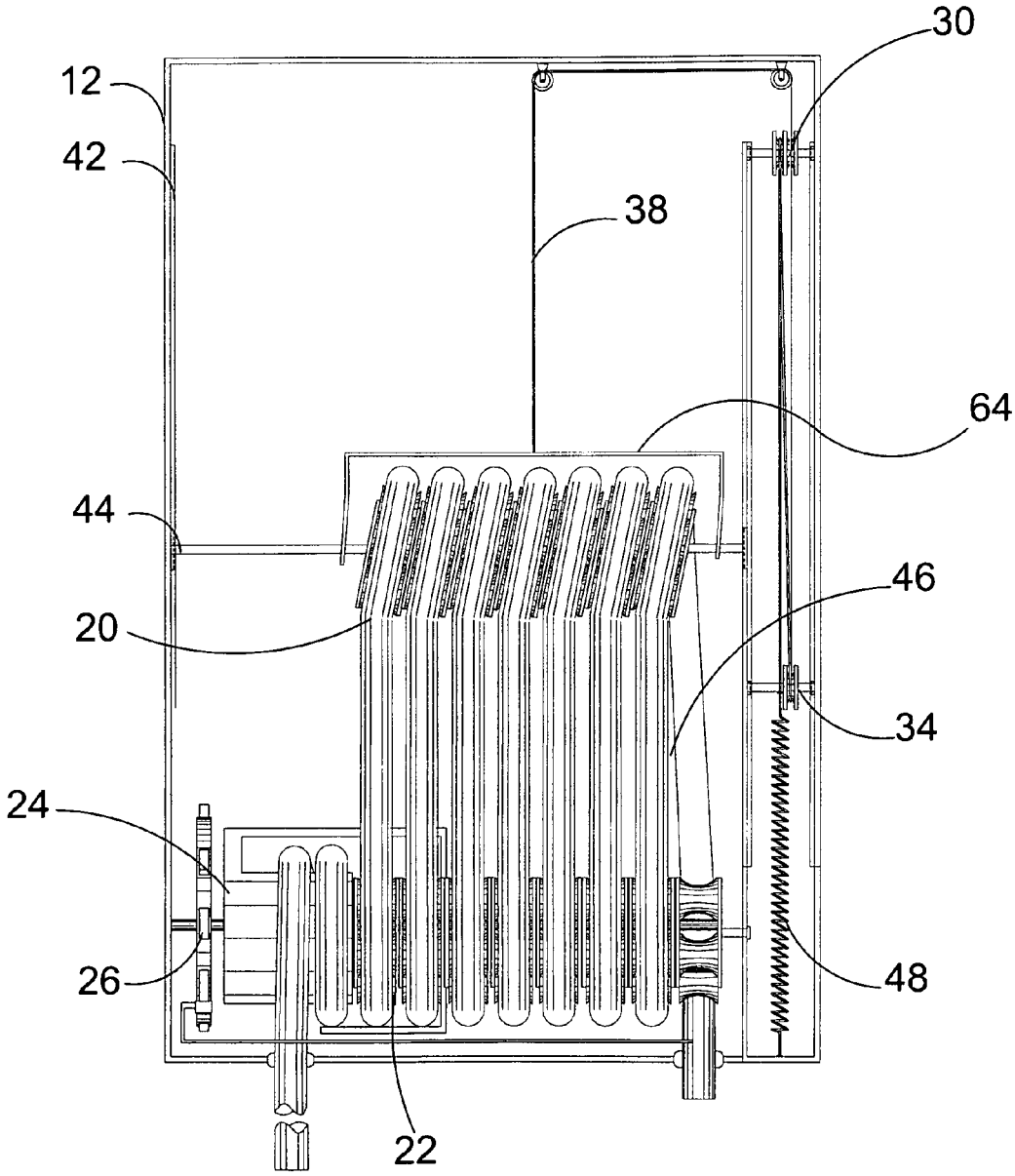
FIG. 5 is a front view of the internal components present invention in the unwound position.
Figure 5A:
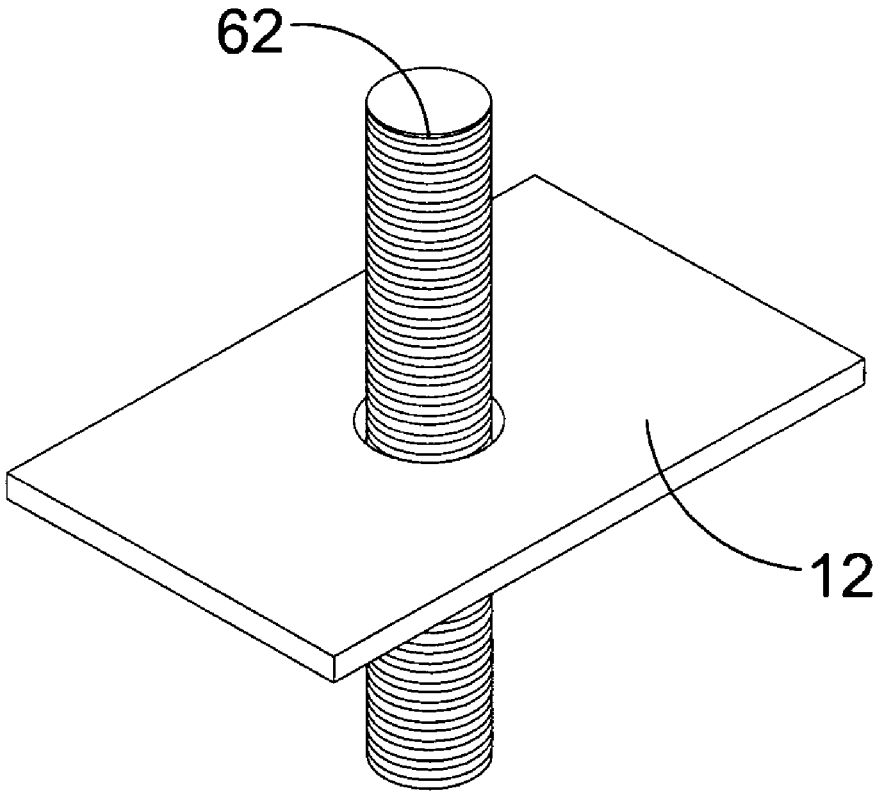
FIG. 5A is a perspective view of the nipple of the present invention.

FIG. 5 is a front view of the internal components of the present invention 10 in the partially unwound position. The upper roller guides 20 have moved toward the lower roller guides 22 causing the spring 48 to be extended by the cable 38 pulling up on the lower pulley 34. The lower pulley 34 has moved upwards while the top roller guides 20 have moved downwards. When the user actuates the release mechanism 14 the energy stored in the block and tackle mechanism 28 causes the upper roller guides 20 to move upwards vertically causing the hose to be drawn into the housing 12. The lower roller guides 22 have an extra row of rollers 54 so as to allow the hose 46 to extend out of the housing 12 so that the hose 46 can be connected to a hose bib to supply the hose 46 with water. It is also contemplated that the hose 46 can be connected to a nipple 62, which is secured to the housing 12. The nipple 62 would be threaded at both ends to allow for hose connections. The end of the nipple 62 which is inside the housing 12 would be provided with a male thread for connecting to the female end of the hose 46. The end of the nipple 62 outside of the housing 12 could be provided with a have a female hose coupling to allow connection to the male end of a hose 46. The coupling would be the same that is used on the female end of a garden hose. It is also contemplated that the nipple 62 may be threaded at both ends with male threads (see FIG. 5A). In this case a connection hose with two female ends could be provided with the device so that the device can be connected to a hose bib. FIG. 5 shows there being seven rows of rollers on the top roller guides 20 and eight rows of rollers on the lower or bottom roller guides 22. It is envisioned that there can be a lesser number of rows or a greater number of rows depending on how much hose 46 is to be stored in the device. It is also contemplated that the upper roller guides 20 and the lower roller guides 22 could be spaced further apart from each other to a greater length of hose 46 in the housing 12. Increasing the number of rows allows for the height of the housing to be shortened while still retaining the same length of hose 46. Each of the rows of the upper and lower roller guides are made up of a plurality of rollers attached to two semicircular braces 50 joined by cross bars 52 as seen in FIGS. 6 and 7.

Figure 6:
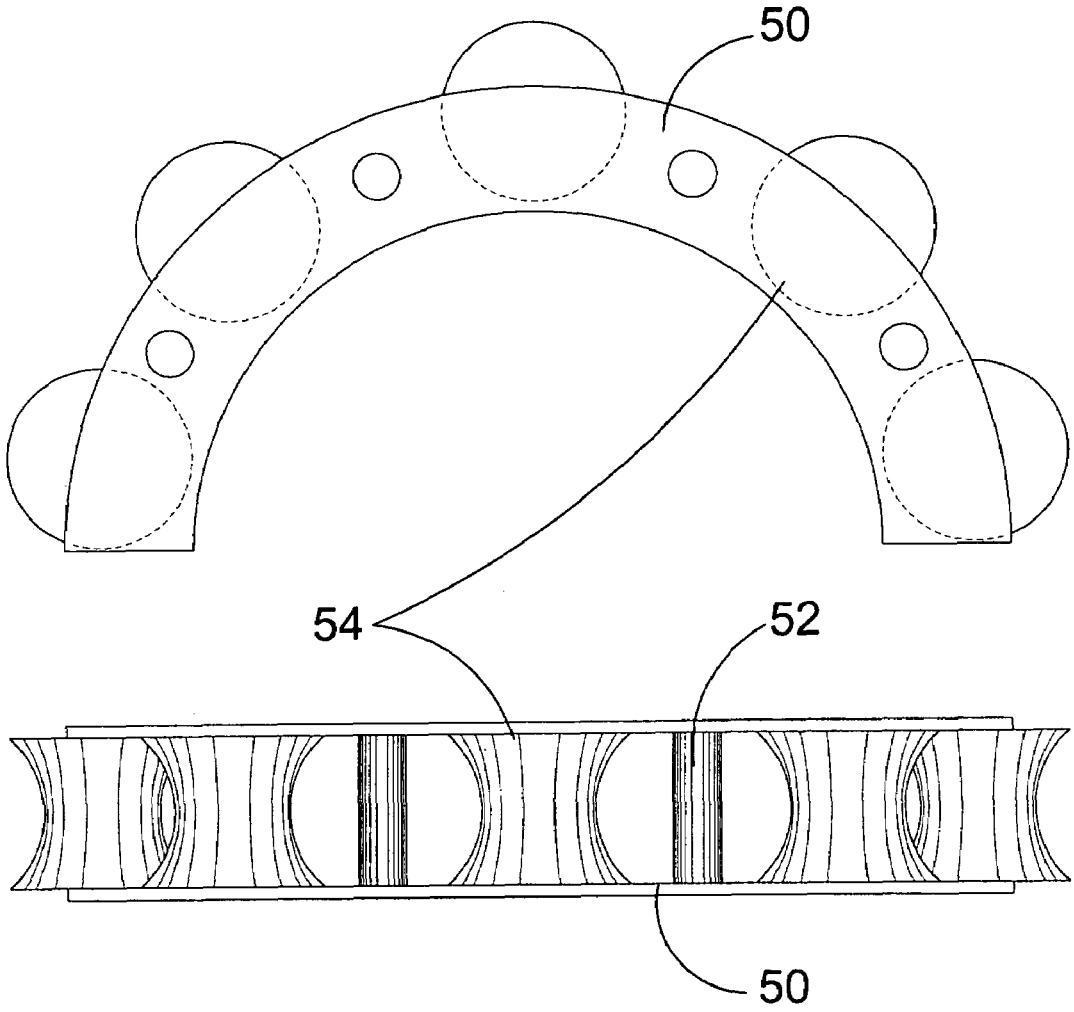
FIG. 6 is a top and side view of the bottom hose guide of the present invention.

FIG. 6 is a top and side view of the one of the rows of the lower roller guides 22 of the present invention 10. Each row is made up of a plurality of rollers 54 configured evenly about a two semicircular braces 50. The rollers 54 can be attached to the braces 50 in a variety of ways. They may be secured with rivets, threaded screws, threaded bolts or the like. The rollers 54 will be attached so that they are provided with free rotational movement to so that the hose 46 can travel smoothly and easily along its path. It is contemplated that the rollers 54 may have a central through hole through which a shaft extends. The shafts could be fixed to one of the braces 50 and extend into a hole in the other brace 50 providing for the desired alignment. The cross bars 42 ensure the proper spacing of the braces 50. They also provide reinforcement to the braces 50. The rollers 54 may be mounted directly to the shafts in the case that the rollers 54 are made of a plastic such as nylon. The plastic of the rollers 54 can act as it own bearing providing the smooth and free rotational movement about the shaft. It is also contemplated that bearings can be employed between the rollers 54 and the shafts. These bearing could be sealed and pre lubricated. These could be of the type used in inline skate wheels. The only requirement is to allow the hose 46 with free and smooth movement along its path.

Figure 7:
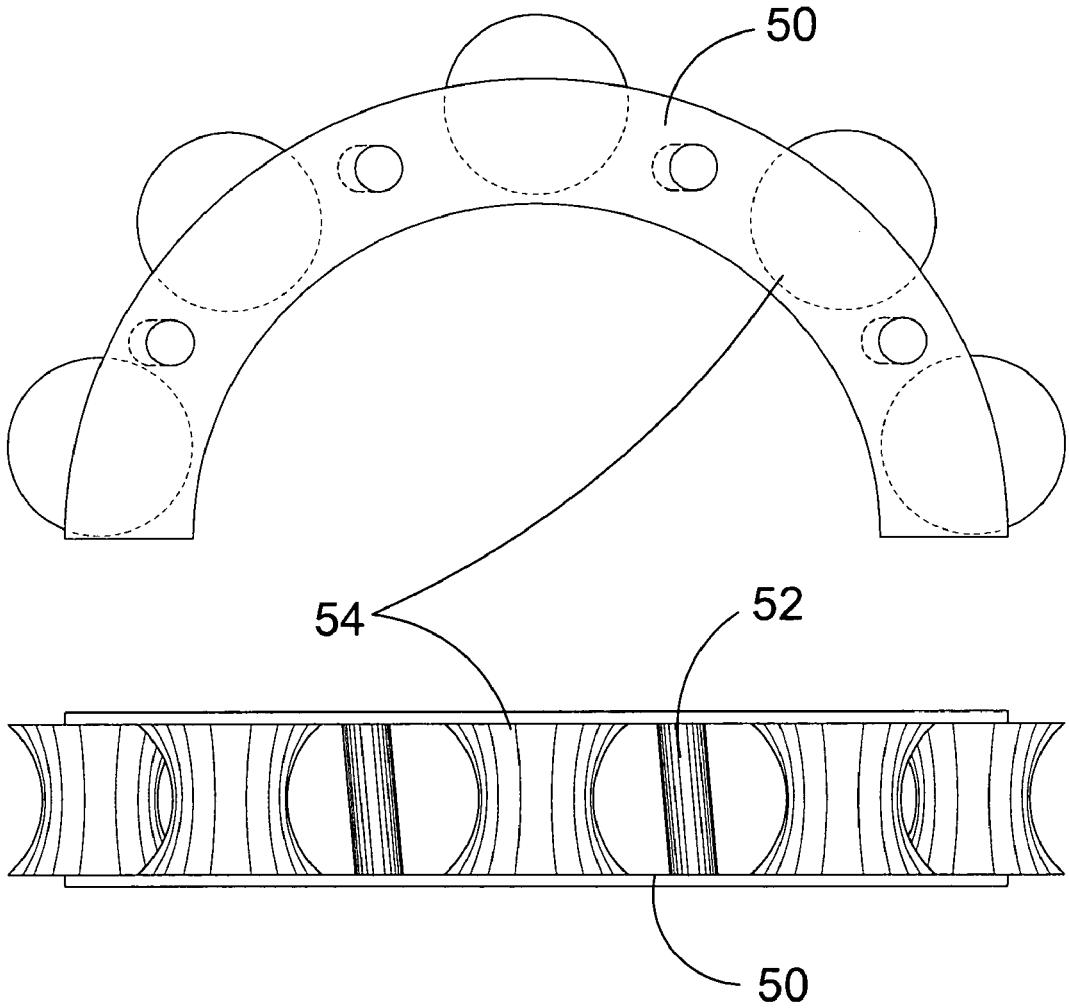
FIG. 7 is a top and side view of the top hose guide of the present invention.

FIG. 7 is a top and side view of one of the rows of the upper roller guides 20 of the present invention 10. Each row is made up of a plurality of rollers 54 configured evenly about two semicircular braces 50. The rollers 54 of the present invention 10 function to guide the hose 46 smoothly and easily to its path. The support braces 50 are angled to improve the continuity of the hose 46 spooling from upper roller guides 20 to the lower roller guides 22. The rollers 54 of the upper roller guides 20 would be mounted the same as those in the lower roller guides 22.

Figure 8:
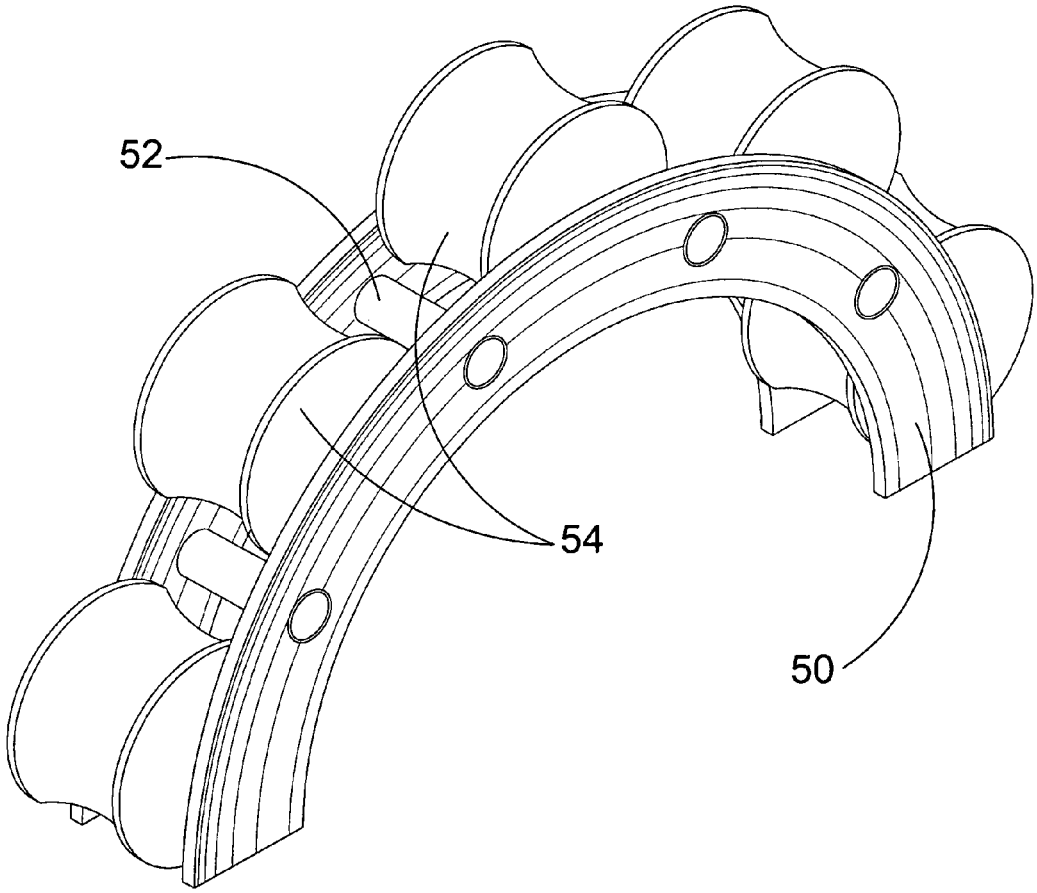
FIG. 8 is a perspective view of the bottom hose guide of the present invention.
Figure 8A:
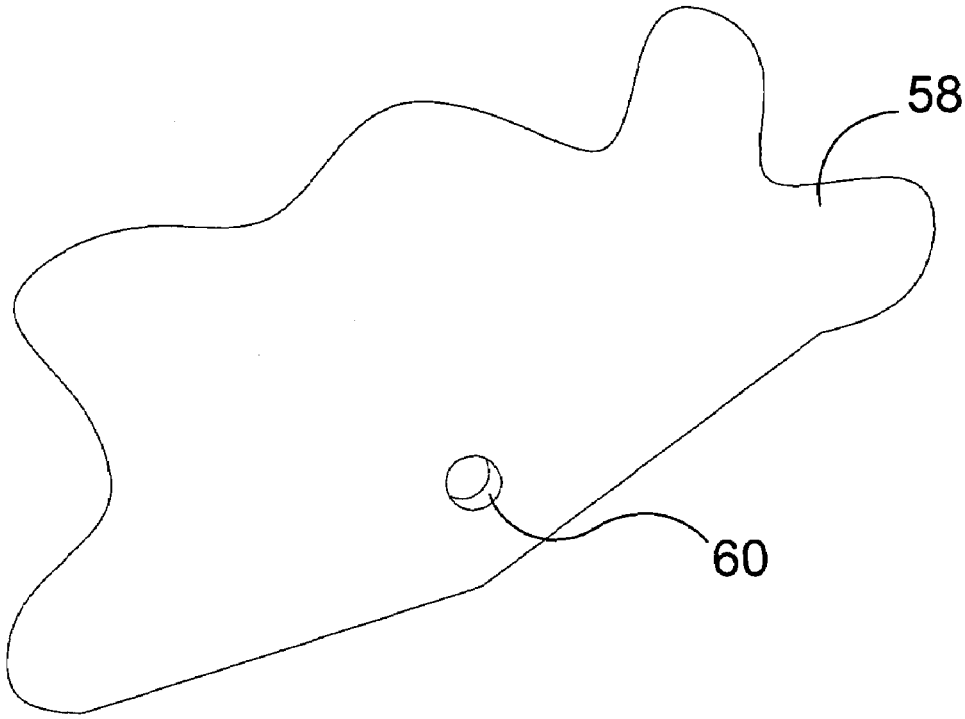
FIG. 8A is a perspective view of a fixing plate of the present invention.

FIG. 8 is a perspective view of one of the rows of the lower roller guides 22 of the present invention 10. Each row is made up of a plurality of rollers 54 configured evenly about two semicircular braces 50 including a plurality of crossbars 52.

Figure 9:
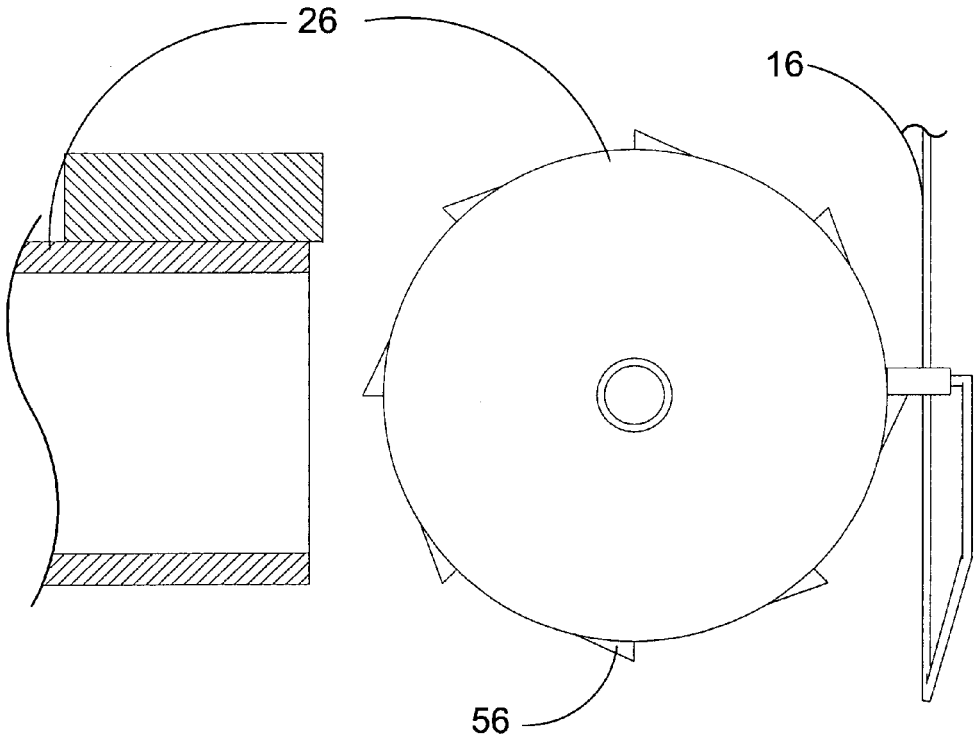
FIG. 9 is a perspective view of the ratchet mechanism of the present invention.

FIG. 9 is a perspective view of the ratchet mechanism 26 of the present invention. Shown is the ratchet mechanism 26 of the present invention utilized for retaining drawn lengths of hose 46 in a pulled state until released by the release mechanism 14 and the linkage 16. When released the block and tackle mechanism 28 coupled to a spring 48 exert a pulling force to withdraw the pulled lengths of hose 46.

Figure 8B:
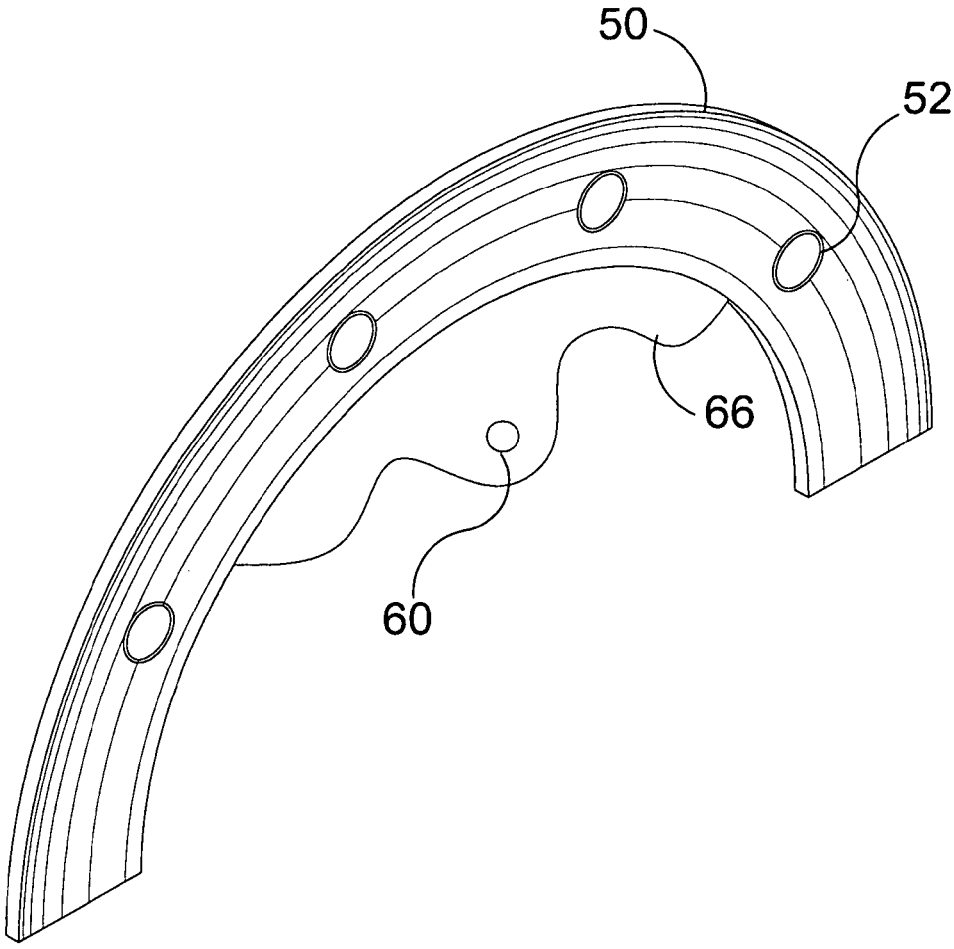
FIG. 8B is perspective view of a modified brace of the present invention.
Figure 10:
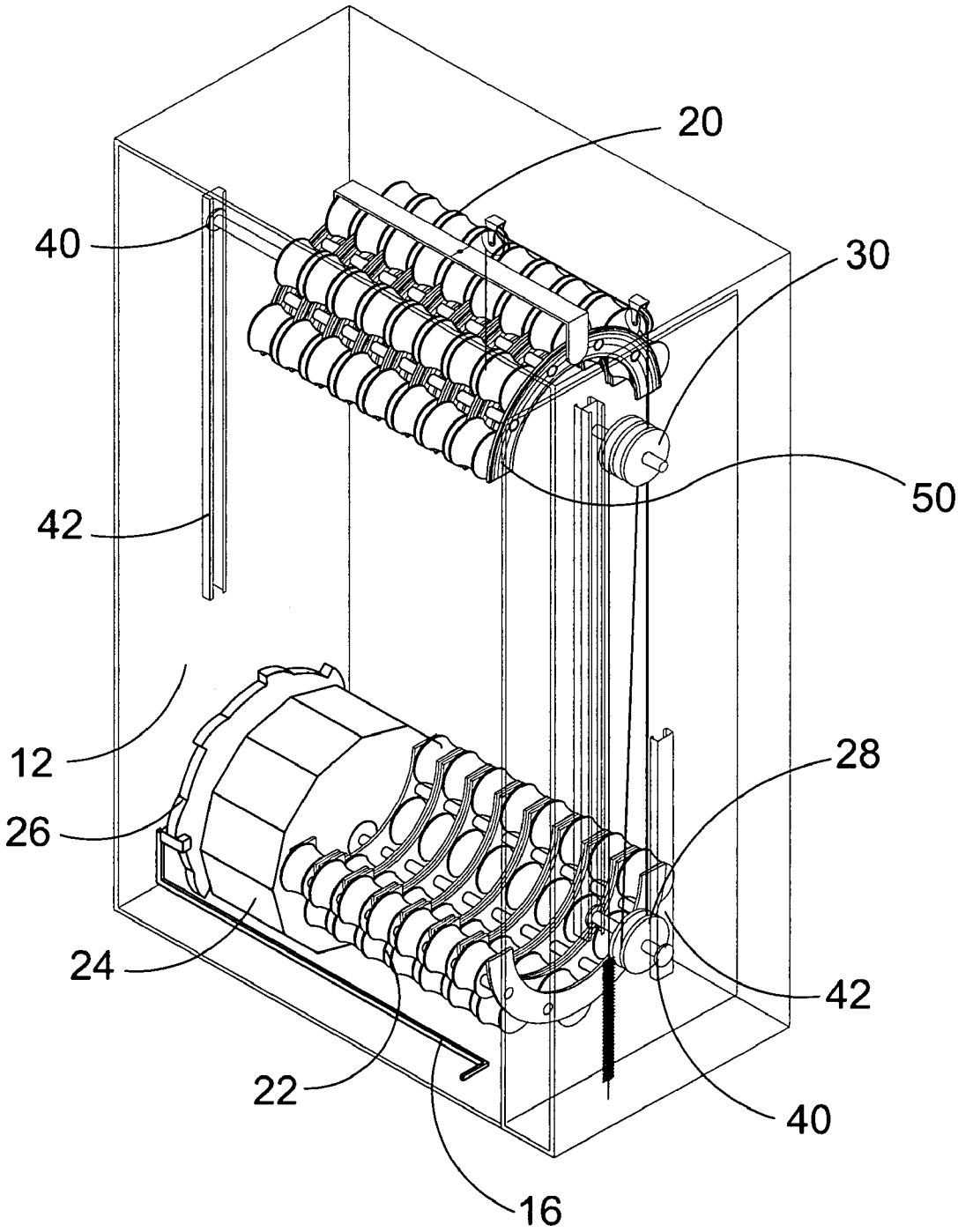
FIG. 10 is a perspective view of the internal components present invention.

FIG. 10 is a perspective view of the internal components of the present invention 10. Shown is the inside of the housing 12 of the present invention depicting the internal components of the present invention 10 showing an upper set of roller guides 20 situated to be raised and lowered during the retraction and extension of hose 46 from the device by usage of a block and tackle mechanism 28. Additionally shown is the present invention 10 having a ratchet mechanism 26 and a brake drum 24 utilized in retaining drawn lengths of hose 46 until selectively released by activating the release mechanism 14. This figure shows that the lifting bar 64 may be connected to the outer braces 50 of the upper roller guides 20 instead of being joined to the guide wheel shaft 44. The guide wheel shaft 44 can be joined to the upper or top roller guides 20 by a plurality of fixing plates 58. A fixing plate 58 could be attached to each of the end braces 50 provide all the intermediate braces 50 are joined together. Intermediary fixing plates 58 could be employed between mating braces 50 to provide further support if required. It is also contemplated that the guide wheel shaft 44 could be positioned through all the braces 50 of the upper roller guides 20 to eliminate the need for fixing plates 58. This could be accomplished by modifying the braces 50 with a lower extension 66 where the lower extension 66 has a through hole 60 to accept the guide wheel shaft 44. This is seen in FIG. 8B.

I claim:

1. A hose storage device comprising a housing for storing the hose, a plurality of upper roller guides, and a plurality of lower roller guides about which the hose is wound, a brake drum with an attached ratchet mechanism for maintaining the hose in an unwound condition, a release mechanism for releasing the ratchet mechanism so that the hose is drawn into the housing by causing the upper roller guides to move away from the lower roller guides, including a block and tackle mechanism, which moves the upper roller guides away from the lower roller guides, where the upper roller guides include a plurality of rows of rollers where each row of rollers include a plurality of rollers mounted on a semicircular brace.

2. The hose storage device of claim 1, including guide tracks for guiding the vertical movement of the upper roller guides.

3. The hose storage device of claim 2, including guide wheels disposed in the guide tracks for guiding the vertical movement of the upper roller guides.

4. The hose storage device of claim 3, where the roller guides are attached to the ends of a guide wheel shaft, said guide wheel shaft is joined to the top roller guides for guiding the vertical movement of the upper roller guides.

5. The hose storage device of claim 1, wherein the block and tackle device employs a plurality of pulleys and a spring for storing energy to move the upper roller guides away from the lower roller guides.

6. The hose storage device of claim 5, where the upper roller guides are joined to the block and tackle mechanism by a lifting bar.

7. The hose storage device of claim 1, including a lifting bar for connecting the block and tackle mechanism to the upper roller guides.

8. The house storage device of claim 4, wherein a lifting bar is joined to the guide wheel shaft, said lifting bar being joined to a block and tackle mechanism, which moved the upper roller guides away from the lower roller guides.

9. The hose storage device of claim 1, wherein the lower roller guides include a plurality of semicircular braces on which a plurality of rollers are mounted, wherein the rollers of the upper roller guides are mounted at an acute angle with respect to the rollers of the lower roller guides.

10. The hose storage device of claim 1, including a nipple mounted through the housing for connecting the hose storage device with a hose bib to provide a source of water.

11. The hose storage device of claim 10, where the nipple is threaded at both ends with male threads and the nipple is secured in a through hole in the housing where a threaded end is accessible from the exterior of the housing and a threaded end is accessible from the interior of the housing.

12. The hose storage device of claim 1, wherein there is at least one opening in the housing capable of allowing a hose to extend there through.

13. The hose storage device of claim 1, wherein the housing has two openings capable of allowing a hose to extend there through.

14. The hose storage device of claim 1, wherein the release mechanism includes linkage and a biasing means for maintaining the linkage in contact with the ratchet mechanism thereby maintaining the hose in an unwound position.

15. A hose storage device comprising a housing for storing the hose, a plurality of upper roller guides, and a plurality of lower roller guides about which the hose is wound, a brake drum with an attached ratchet mechanism for maintaining the hose in an unwound condition, a release mechanism for releasing the ratchet mechanism so that the hose is drawn into the housing by causing the upper roller guides to move away from the lower roller guides, including a block and tackle mechanism, which moves the upper roller guides away from the lower roller guides, wherein the block and tackle device employs a plurality of pulleys and a spring for storing energy to move the upper roller guides away from the lower roller guides, wherein the plurality of pulleys includes two pulleys on a fixed shaft and a single pulley on a movable shaft and said single pulley is joined to the spring.

16. The hose storage device of claim 15, wherein the movable shaft has guide wheels attached to each end and each of the guide wheels is disposed in a guide track.

17. The hose storage device of claim 16, wherein each of the guide tracks has a closed end or a stop located adjacent each end for retaining the guide wheels in the guide tracks.

18. A hose storage device comprising a housing for storing the hose, plurality of upper roller guides, and a plurality of lower roller guides about which the hose is wound, a brake drum with an attached ratchet mechanism for maintaining the hose in an unwound condition, a block and tackle mechanism, which moves the upper roller guides away from the lower roller guides, wherein each of the upper and lower roller guides has a plurality of semicircular braces, wherein each of the braces have a plurality of rollers mounted thereon, and the rollers of the upper roller guides are mounted at an acute angle with respect to the rollers of the lower roller guides.

* * * * *